US008821134B2

(12) United States Patent
Van Rensburg

(10) Patent No.: US 8,821,134 B2
(45) Date of Patent: Sep. 2, 2014

(54) FLUID DISC PUMP

(75) Inventor: Richard Janse Van Rensburg, Cambridgeshire (GB)

(73) Assignee: The Technology Partnership Plc, Hertfordshire (GB)

( * ) Notice: Subject to any disclaimer, the term of this patent is extended or adjusted under 35 U.S.C. 154(b) by 976 days.

(21) Appl. No.: 12/477,594

(22) Filed: Jun. 3, 2009

(65) Prior Publication Data

US 2010/0310397 A1 Dec. 9, 2010

(51) Int. Cl.
*F04B 17/00* (2006.01)
*F04B 43/04* (2006.01)
*F04F 7/00* (2006.01)

(52) U.S. Cl.
CPC .. *F04B 43/04* (2013.01); *F04F 7/00* (2013.01)
USPC ..... 417/413.1; 417/213; 417/307; 417/413.2

(58) Field of Classification Search
USPC ..... 417/413.2, 213, 286, 299, 301–304, 417/307, 413.1, 410.2; 137/493, 493.8, 137/493.9, 565.01; 977/723, 724
See application file for complete search history.

(56) References Cited

U.S. PATENT DOCUMENTS 6,203,291 B1 * 3/2001 Stemme et al. ..... 417/413.3
6,247,905 B1 * 6/2001 Dohner ..... 417/322
7,258,774 B2 * 8/2007 Chou et al. ..... 204/450
2004/0000843 A1 1/2004 East
2009/0087323 A1 * 4/2009 Blakey et al. ..... 417/413.2

FOREIGN PATENT DOCUMENTS

DE 44 22 743 A1 1/1996
JP 2009-156454 7/2009
WO WO-94/19609 A1 9/1994
WO WO9600849 * 1/1996
WO WO-2004/090335 A1 10/2004
WO WO-2005/001287 A1 1/2005
WO WO 2006/111775 A1 10/2006
WO WO-2009-072261 A1 6/2009
WO WO-2009-087714 A1 7/2009

* cited by examiner

*Primary Examiner* — Anh Mai
*Assistant Examiner* — Fatima Farokhrooz
(74) *Attorney, Agent, or Firm* — Tarolli, Sundheim, Covell & Tummino LLP

(57) ABSTRACT

A pump having a substantially cylindrical shape and defining a cavity formed by a side wall closed at both ends by end walls wherein the cavity contains a fluid is disclosed. The pump further comprises an actuator operatively associated with at least one of the end walls to cause an oscillatory motion of the driven end wall to generate displacement oscillations of the driven end wall within the cavity. The pump further comprises an isolator operatively associated with a peripheral portion of the driven end wall to reduce dampening of the displacement oscillations.

54 Claims, 9 Drawing Sheets

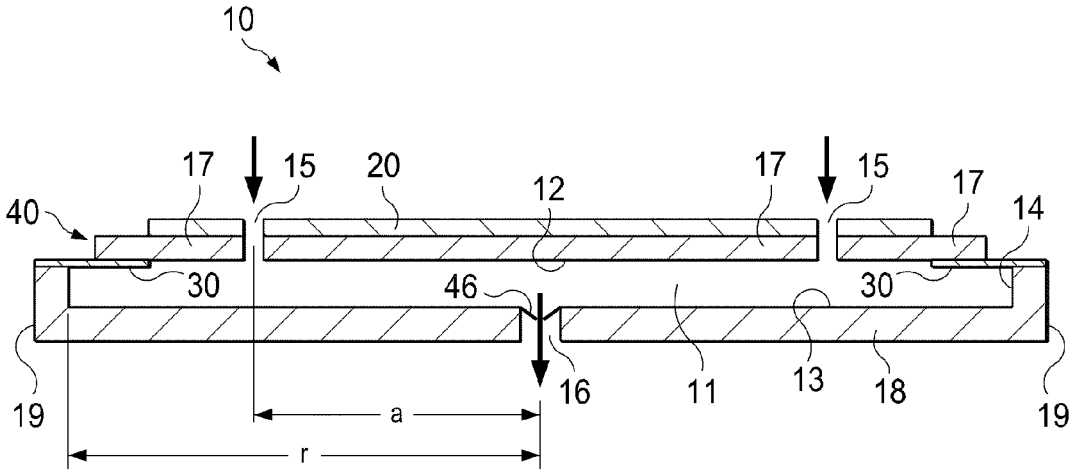
FIG. 1A
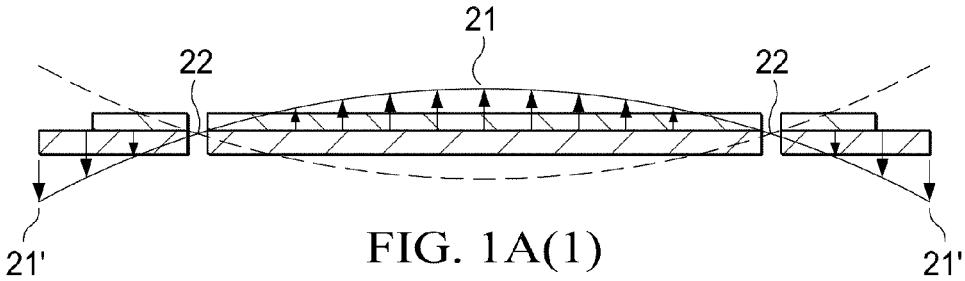
FIG. 1A(1)
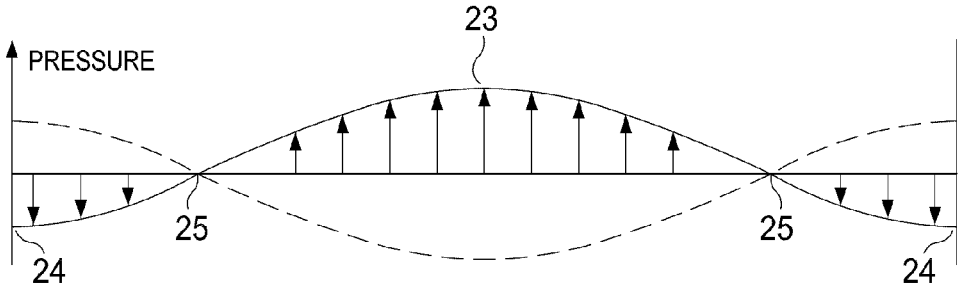
FIG. 1A(2)

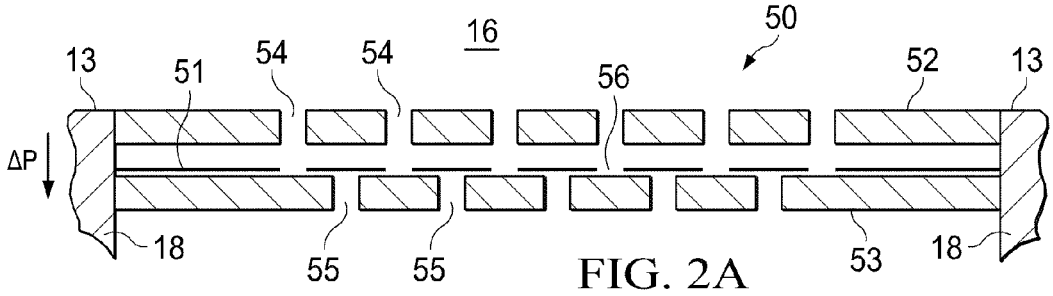
FIG. 2A
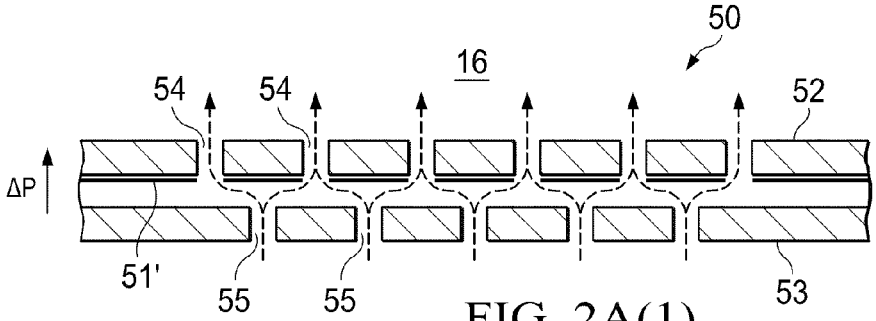
FIG. 2A(1)
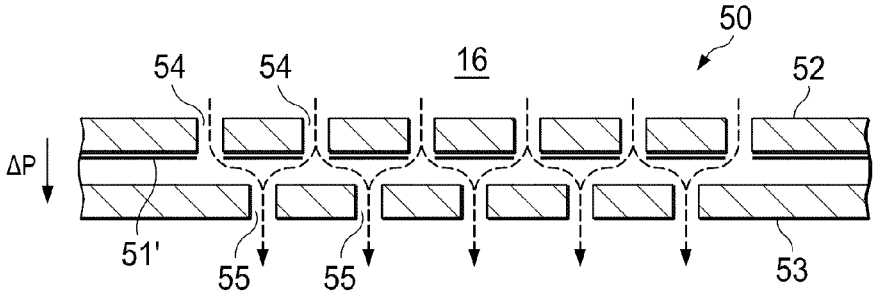
FIG. 2A(2)

FLUID DISC PUMP

BACKGROUND OF THE INVENTION

1. Field of the Invention

The illustrative embodiments of the invention relate generally to a pump for fluid and, more specifically, to a pump in which the pumping cavity is substantially a disc-shaped, cylindrical cavity having substantially circular end walls and a side wall.

2. Description of Related Art

The generation of high amplitude pressure oscillations in closed cavities has received significant attention in the fields of thermo-acoustics and pump type compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, bulb have been used to achieve high amplitude pressure oscillations thereby significantly increasing the pumping effect. In such high amplitude waves the non-linear mechanisms with energy dissipation have been suppressed. However, high amplitude acoustic resonance has not been employed within disc-shaped cavities in which radial pressure oscillations are excited until recently. International Patent Application No. PCT/GB2006/001487, published as WO 2006/111775 (the '487 application), discloses a pump having a substantially disc-shaped cavity with a high aspect ratio, i.e., the ratio of the radius of the cavity to the height of the cavity.

Such a pump has a substantially cylindrical cavity comprising a side wall closed at each end by end walls. The pump also comprises an actuator that drives either one of the end walls to oscillate in a direction substantially perpendicular to the surface of the driven end wall. The spatial profile of the motion of the driven end wall is described as being matched to the spatial profile of the fluid pressure oscillations within the cavity, a state described herein as mode-matching. When the pump is mode-matched, work done by the actuator on the fluid in the cavity adds constructively across the driven end wall surface, thereby enhancing the amplitude of the pressure oscillation in the cavity and delivering high pump efficiency. In a pump which is not mode-matched there may be areas of the end wall wherein the work done by the end wall on the fluid reduces rather than enhances the amplitude of the fluid pressure oscillation in the fluid within the cavity. Thus, the useful work done by the actuator on the fluid is reduced and the pump becomes less efficient. The efficiency of a mode-matched pump is dependent upon the interface between the driven end wall and the side wall. It is desirable to maintain the efficiency of such pump by structuring the interface so that it does not decrease or dampen the motion of the driven end wall thereby mitigating any reduction in the amplitude of the fluid pressure oscillations within the cavity.

SUMMARY

According to one embodiment of the invention, the actuator of the pump described above causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall within the cavity. The axial oscillations of the driven end wall generate substantially proportional "pressure oscillations" of fluid within the cavity creating a radial pressure distribution approximating that of a Bessel function of the first kind as described in the '487 Application which is incorporated by reference herein, such oscillations referred to hereinafter as "radial oscillations" of the fluid pressure within the cavity. A portion of the driven end wall between the actuator and the side wall provides an interface with the side wall of the pump that decreases dampening of the displacement oscillations to mitigate any reduction of the pressure oscillations within the cavity, that portion being referred to hereinafter as an "isolator." The illustrative embodiments of the isolator are operatively associated with the peripheral portion of the driven end wall to reduce dampening of the displacement oscillations.

According to another embodiment of the invention, a pump comprises a pump body having a substantially cylindrical shape defining a cavity formed by a side wall closed at both ends by substantially circular end walls, at least one of the end walls being a driven end wall having a central portion and a peripheral portion adjacent the side wall, wherein the cavity contains a fluid when in use. The pump further comprises an actuator operatively associated with the central portion of the driven end wall to cause an oscillatory motion of the driven end wall in a direction substantially perpendicular thereto with a maximum amplitude at about the centre of the driven end wall, thereby generating displacement oscillations of the driven end wall when in use. The pump further comprises an isolator operatively associated with the peripheral portion of the driven end wall to reduce dampening of the displacement oscillations caused by the end wall's connection to the side wall of the cavity. The pump further comprises a first aperture disposed at about the centre of one of the end walls, and a second aperture disposed at any other location in the pump body, whereby the displacement oscillations generate radial oscillations of fluid pressure within the cavity of said pump body causing fluid flow through said apertures.

Other objects, features, and advantages of the illustrative embodiments will become apparent with reference to the drawings and detailed description that follow.

BRIEF DESCRIPTION OF THE DRAWINGS

FIG. 1A shows a schematic cross-section view of a first pump according to an illustrative embodiment of the inventions that provide a positive pressure;

FIG. 1A(1) is a displacement profile illustrating the axial oscillation of the driven end wall of the pump in FIG. 1A;

FIG. 1A(2) is a graph of the pressure oscillations within the cavity of the pump in FIG. 1A;

FIG. 2A shows a schematic cross-section view of a valve for use with the pumps according to the illustrative embodiments of the invention;

FIGS. 2A(1) and 2A(2) show a section of the valve of FIG. 2A in operation;

DETAILED DESCRIPTION OF ILLUSTRATIVE EMBODIMENTS

In the following detailed description of several illustrative embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1B:
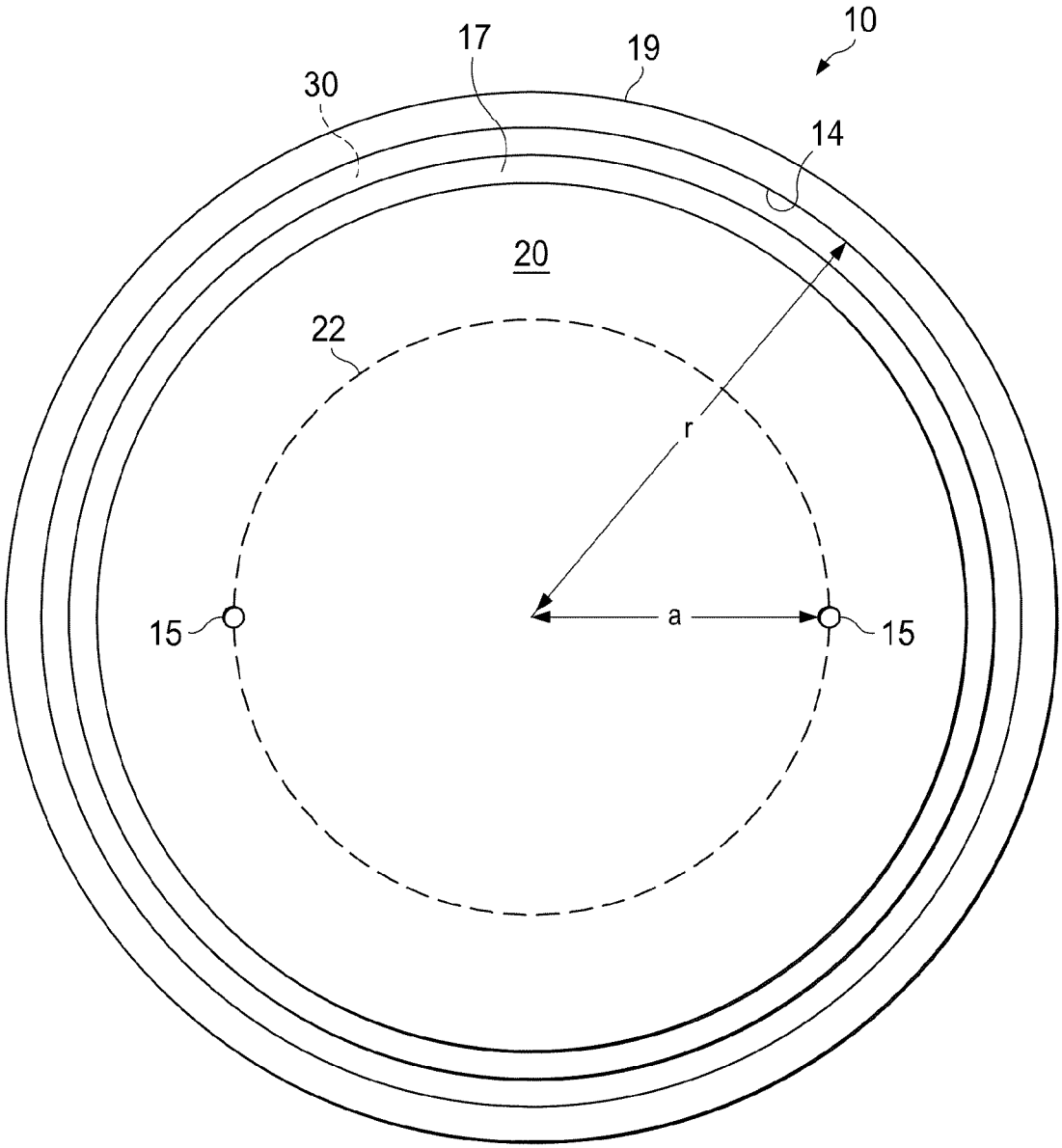
FIG. 1B shows a schematic top view of the first pump of FIG. 1A.

FIG. 1A is a schematic cross-section view of a pump 10 according to an illustrative embodiment of the invention. Referring also to FIG. 1B, pump 10 comprises a pump body having a substantially cylindrical shape including a cylindrical wall 19 closed at one end by a base 18 and closed at the other end by an end plate 17 and a ring-shaped isolator 30 disposed between the end plate 17 and the other end of the cylindrical wall 19 of the pump body. The cylindrical wall 19 and base 18 may be a single component comprising the pump body and may be mounted to other components or systems. The internal surfaces of the cylindrical wall 19, the base 18, the end plate 17, and the isolator 30 form a cavity 11 within the pump 10 wherein the cavity 11 comprises a side wall 14 closed at both ends by end walls 12 and 13. The end wall 13 is the internal surface of the base 18 and the side wall 14 is the inside surface of the cylindrical wall 19. The end wall 12 comprises a central portion corresponding to the inside surface of the end plate 17 and a peripheral portion corresponding to the inside surface of the isolator 30. Although the cavity 11 is substantially circular in shape, the cavity 11 may also be elliptical or other shape. The base 18 and cylindrical wall 19 of the pump body may be formed from any suitable rigid material including, without limitation, metal, ceramic, glass, or plastic.

The pump 10 also comprises a piezoelectric disc 20 operatively connected to the end plate 17 to form an actuator 40 that is operatively associated with the central portion of the end wall 12 via the end plate 17. The piezoelectric disc 20 is not required to be formed of a piezoelectric material, but may be formed of any electrically active material such as, for example, an electrostrictive or magnetostrictive material. The end plate 17 preferably possesses a bending stiffness similar to the piezoelectric disc 20 and may be formed of an electrically inactive material such as a metal or ceramic. When the piezoelectric disc 20 is excited by an oscillating electrical current, the piezoelectric disc 20 attempts to expand and contract in a radial direction relative to the longitudinal axis of the cavity 11 causing the end plate 17 to bend, thereby inducing an axial deflection of the end wall 12 in a direction substantially perpendicular to the end wall 12. The end plate 17 alternatively may also be formed from an electrically active material such as, for example, a piezoelectric, magnetostrictive, or electrostrictive material. In another embodiment, the piezoelectric disc 20 may be replaced by a device in a force-transmitting relation with the end wall 12 such as, for example, a mechanical, magnetic or electrostatic device, wherein the end wall 12 may be formed as an electrically inactive or passive layer of material driven into oscillation by such device (not shown) in the same manner as described above.

The pump 10 further comprises at least two apertures extending from the cavity 11 to the outside of the pump 10, wherein at least a first one of the apertures may contain a valve to control the flow of fluid through the aperture. Although the aperture containing a valve may be located at any position in the cavity 11 where the actuator 40 generates a pressure differential as described below in more detail, one preferred embodiment of the pump 10 comprises an aperture with a valve located at approximately the centre of either of the end walls 12,13. The pump 10 shown in FIGS. 1A and 1B comprises a primary aperture 16 extending from the cavity 11 through the base 18 of the pump body at about the centre of the end wall 13 and containing a valve 46. The valve 46 is mounted within the primary aperture 16 and permits the flow of fluid in one direction as indicated by the arrow so that it functions as an outlet for the pump 10. The second aperture 15 may be located at any position within the cavity 11 other than the location of the aperture 16 with the valve 46. In one preferred embodiment of the pump 10, the second aperture is disposed between the centre of either one of the end walls 12,13 and the side wall 14. The embodiment of the pump 10 shown in FIGS. 1A and 1B comprises two secondary apertures 15 extending from the cavity 11 through the actuator 40 that are disposed between the centre of the end wall 12 and the side wall 14. Although the secondary apertures 15 are not valved in this embodiment of the pump 10, they may also be valved to improve performance if necessary. In this embodiment of the pump 10, the primary aperture 16 is valved so that the fluid is drawn into the cavity 11 of the pump 10 through the secondary apertures 15 and pumped out of the cavity 11 through the primary aperture 16 as indicated by the arrows to provide a positive pressure at the primary aperture 16.

Figure 3:
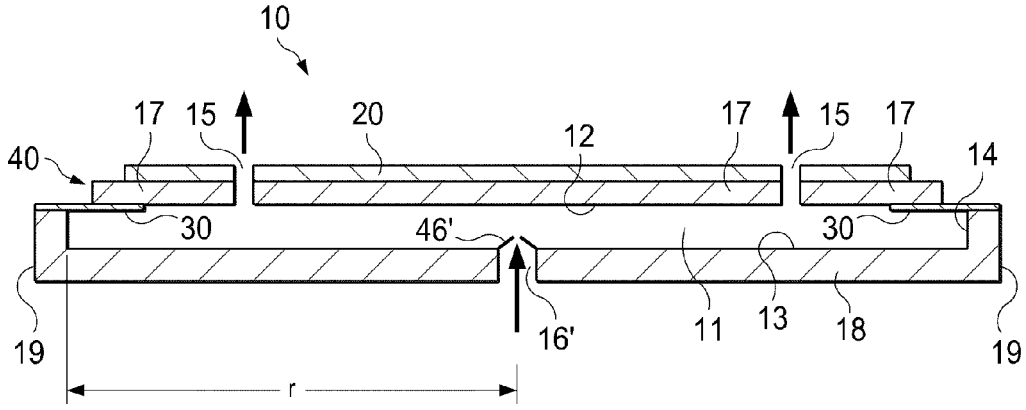
FIG. 3 shows a schematic cross-section view of a second pump according to an illustrative embodiment of the inventions that provides a negative pressure.

Referring to FIG. 3, the pump 10 of FIG. 1 is shown with an alternative configuration of the primary aperture 16. More specifically, the valve 46' in the primary aperture 16' is reversed so that the fluid is drawn into the cavity 11 through the primary aperture 16' and expelled out of the cavity 11 through the secondary apertures 15 as indicated by the arrows, thereby providing suction or a source of reduced pressure at the primary aperture 16'. The term "reduced pressure" as used herein generally refers to a pressure less than the ambient pressure where the pump 10 is located. Although the term "vacuum" and "negative pressure" may be used to describe the reduced pressure, the actual pressure reduction may be significantly less than the pressure reduction normally associated with a complete vacuum. The pressure is "negative" in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

The valves 46 and 46' allow fluid to flow through in substantially one direction as described above. The valves 46 and 46' may be a ball valve, a diaphragm valve, a swing valve, a duck-bill valve, a clapper valve, a lift valve, or any other type of check valve or any other valve that allows fluid to flow substantially in only one direction. Some valve types may regulate fluid flow by switching between an open and closed position. For such valves to operate at the high frequencies generated by the actuator 40, the valves 46 and 46' must have an extremely fast response time such that they are able to open and close on a timescale significantly shorter than the timescale of the pressure variation. One embodiment of the valves 46 and 46' achieve this by employing an extremely light flap valve which has low inertia and consequently is able to move rapidly in response to changes in relative pressure across the valve structure.

Figure 2B:
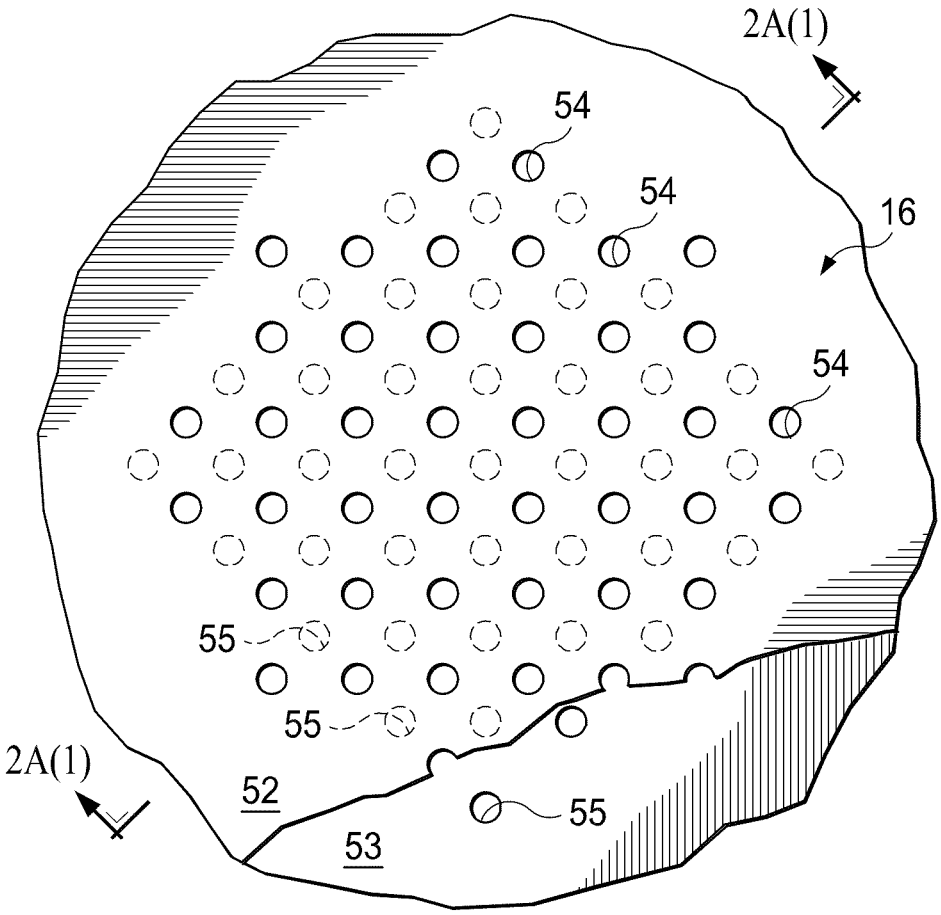
FIG. 2B shows a schematic top view of the valve of FIG. 2A.

Referring more specifically to FIG. 2A, a schematic cross-section view of one embodiment of a flap valve 50 is shown mounted within the aperture 16 (or 16'). The flap valve 50 comprises a flap 51 disposed between a retention plate 52 and a sealing plate 53 and biased against the sealing plate 53 in a "closed" position which seals the flap valve 50 when not in use, i.e., the flap valve 50 is normally closed. The valve 50 is mounted within the aperture 16 so that the upper surface of the retention plate 52 is preferably flush with the end wall 13 to maintain the resonant quality of the cavity 11. The retention plate 52 and the sealing plate 53 both have vent holes 54 and 55 respectively that extend from one side of the plate to the other as represented by the dashed and solid circles, respectively, in FIG. 2B which is a top view of the flap valve 50 of FIG. 2A. The flap 51 also has vent holes 56 which are generally aligned with the vent holes 54 of the retention plate 52 to provide a passage through which fluid may flow as indicated by the dashed arrows in FIG. 2A(1). However, as can be seen in FIGS. 2A and 2B, the vent holes 54 of the retention plate 52 and the vent holes 56 of the flap 51 are not in alignment with the vent holes 55 of the sealing plate 53 which are blocked by the flap 51 when in the "closed" position as shown so that fluid cannot flow through the flap valve 50.

The operation of the flap valve 50 is a function of the change in direction of the differential pressure (ΔP) of the fluid across the flap valve 50. In FIG. 2A, the differential pressure has been assigned a negative value (−ΔP) as indicated by the downward pointing arrow. This negative differential pressure (−ΔP) drives the flap 51 into the fully closed position as described above wherein the flap 51 is sealed against the sealing plate 53 to block the vent holes 55 and prevent the flow of fluid through the flap valve 50. When the differential pressure across the flap valve 50 reverses to become a positive differential pressure (+ΔP) as indicated by the upward pointing arrow in FIG. 2A(1), the biased flap 51 is motivated away from the sealing plate 53 against the retention plate 52 into an "open" position. In this position, the movement of the flap 51 unblocks the vent holes 55 of the sealing plate 53 so that fluid is permitted to flow through vent holes 55 and then the aligned vent holes 56 of the flap 51 and vent holes 54 of the retention plate 52 as indicated by the dashed arrows. When the differential pressure changes back to a negative differential pressure (−ΔP) as indicated by the downward pointing arrow in FIG. 2A(2), fluid begins flowing in the opposite direction through the flap valve 50 as indicated by the dashed arrows which forces the flap 51 back toward the closed position shown in FIG. 2A. Thus, the changing differential pressure cycles the flap valve 50 between closed and open positions to block the flow of fluid after closing the flap 51 when the differential pressure changes from a positive to a negative value. It should be understood that flap 51 could be biased against the retention plate 52 in an "open" position when the flap valve 50 is not in use depending upon the application of the flap valve 50, i.e., the flap valve would then be normally open.

Figure 4:
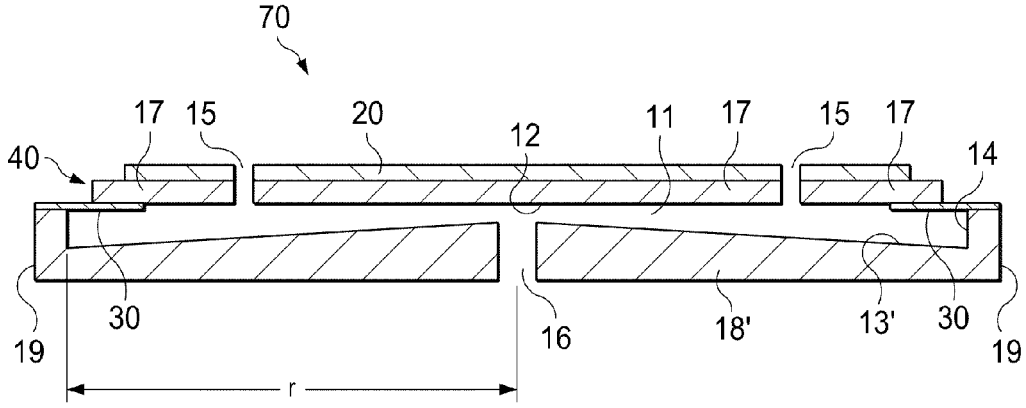
FIG. 4 shows a schematic cross-section view of a third pump according to an illustrative embodiment of the inventions having a frusto-conical base.

Referring now to FIG. 4, a pump 70 according to another illustrative embodiment of the invention is shown. The pump 70 is substantially similar to the pump 10 of FIG. 1 except that the pump body has a base 18' having an upper surface forming the end wall 13' which is frusto-conical in shape. Consequently, the height of the cavity 11 varies from the height at the side wall 14 to a smaller height between the end walls 12,13' at the centre of the end walls 12,13'. The frusto-conical shape of the end wall 13' intensifies the pressure at the centre of the cavity 11 where the height of the cavity 11 is smaller relative to the pressure at the side wall 14 of the cavity 11 where the height of the cavity 11 is larger. Therefore, comparing cylindrical and frusto-conical cavities 11 having equal central pressure amplitudes, it is apparent that the frusto-conical cavity 11 will generally have a smaller pressure amplitude at positions away from the centre of the cavity 11: the increasing height of the cavity 11 acts to reduce the amplitude of the pressure wave. As the viscous and thermal energy losses experienced during the oscillations of the fluid in the cavity 11 both increase with the amplitude of such oscillations, it is advantageous to the efficiency of the pump 70 to reduce the amplitude of the pressure oscillations away from the centre of the cavity 11 by employing a frusto-conical cavity 11 design. In one illustrative embodiment of the pump 70 where the diameter of the cavity 11 is approximately 20 mm, the height of the cavity 11 at the side wall 14 is approximately 1.0 mm tapering to a height at the centre of the end wall 13' of approximately 0.3 mm. Either one of the end walls 12,13 or both of the end walls 12,13 may have a frusto-conical shape.

Figure 5:
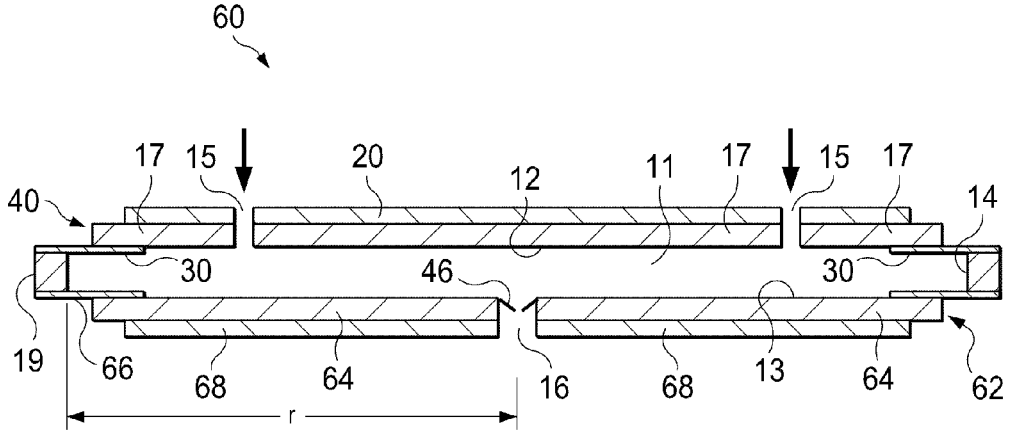
FIG. 5 shows a schematic cross-section view of a fourth pump according to another illustrative embodiment of the invention including two actuators.

Referring now to FIG. 5, a pump 60 according to another illustrative embodiment of the invention is shown. The pump 60 is substantially similar to the pump 10 of FIG. 1 except that it includes a second actuator 62 that replaces the base 18 of the pump body. The actuator 62 comprises a second disc 64 and a ring-shaped isolator 66 disposed between the disc 64 and the side wall 14. The pump 60 also comprises a second piezoelectric disc 68 operatively connected to the disc 64 to form the actuator 62. The actuator 62 is operatively associated with the end wall 13 which comprises the inside surfaces of the disc 64 and the isolator 66. The second actuator 62 also generates an oscillatory motion of the end wall 13 in a direction substantially perpendicular to the end wall 13 in a manner similar to the actuator 40 with respect to the end wall 12 as described above. When the actuators 40, 62 are activated, control circuitry (not shown) is provided to coordinate the axial displacement oscillations of the actuators. It is preferable that the actuators are driven at the same frequency and approximately out-of-phase, i.e. such that the centres of the end walls 12, 13 move first towards each other and then apart.

The dimensions of the pumps described herein should preferably satisfy certain inequalities with respect to the relationship between the height (h) of the cavity 11 and the radius (r) of the cavity which is the distance from the longitudinal axis of the cavity 11 to the side wall 14. These equations are as follows:

$$r/h>1.2; \text{ and}$$

$$h^2/r>4\times10^{-10} \text{ meters.}$$

In one embodiment of the invention, the ratio of the cavity radius to the cavity height (r/h) is between about 10 and about 50 when the fluid within the cavity 11 is a gas. In this example, the volume of the cavity 11 may be less than about 10 ml. Additionally, the ratio of $h^2/r$ is preferably within a range between about $10^{-3}$ and about $10^{-6}$ meters where the working fluid is a gas as opposed to a liquid.

In one embodiment of the invention the secondary apertures 15 are located where the amplitude of the pressure oscillations within the cavity 11 is close to zero, i.e., the "nodal" points of the pressure oscillations. Where the cavity 11 is cylindrical, the radial dependence of the pressure oscillation may be approximated by a Bessel function of the first kind and the radial node of the lowest-order pressure oscillation within the cavity occurs at a distance of approximately 0.63r±0.2r from the centre of the end wall 12 or the longitudinal axis of the cavity 11. Thus, the secondary apertures 15 are preferably located at a radial distance (a) from the centre of the end walls 12,13, where (a)≈0.63r±0.2r, i.e., close to the nodal points of the pressure oscillations.

Additionally, the pumps disclosed herein should preferably satisfy the following inequality relating the cavity radius (r) and operating frequency (f) which is the frequency at which the actuator 40 vibrates to generate the axial displacement of the end wall 12. The inequality equation is as follows:

$$\frac{k_0(c_s)}{2\pi f} \le r \le \frac{k_0(c_f)}{2\pi f}$$

wherein the speed of sound in the working fluid within the cavity 11 (c) may range between a slow speed ($c_s$) of about 115 m/s and a fast speed ($c_f$) equal to about 1,970 m/s as expressed in the equation above, and $k_0$ is a constant ($k_0$=3.83). The frequency of the oscillatory motion of the actuator 40 is preferably about equal to the lowest resonant frequency of radial pressure oscillations in the cavity 11, but may be within 20% therefrom. The lowest resonant frequency of radial pressure oscillations in the cavity 11 is preferably greater than 500 Hz.

Referring now to the pump 10 in operation, the piezoelectric disc 20 is excited to expand and contract in a radial direction against the end plate 17 which causes the actuator 40 to bend, thereby inducing an axial displacement of the driven end wall 12 in a direction substantially perpendicular to the driven end wall 12. The actuator 40 is operatively associated with the central portion of the end wall 12 as described above so that the axial displacement oscillations of the actuator 40 cause axial displacement oscillations along the surface of the end wall 12 with maximum amplitudes of oscillations, i.e., anti-node displacement oscillations, at about the centre of the end wall 12. Referring back to FIG. 1A, the displacement oscillations and the resulting pressure oscillations of the pump 10 as generally described above are shown more specifically in FIGS. 1A(1) and 1A(2), respectively. The phase relationship between the displacement oscillations and pressure oscillations may vary, and a particular phase relationship should not be implied from any figure.

FIG. 1A(1) shows one possible displacement profile illustrating the axial oscillation of the driven end wall 12 of the cavity 11. The solid curved line and arrows represent the displacement of the driven end wall 12 at one point in time, and the dashed curved line represents the displacement of the driven end wall 12 one half-cycle later. The displacement as shown in this figure and the other figures is exaggerated. Because the actuator 40 is not rigidly mounted at its perimeter, but rather suspended by the isolator 30, the actuator 40 is free to oscillate about its centre of mass in its fundamental mode. In this fundamental mode, the amplitude of the displacement oscillations of the actuator 40 is substantially zero at an annular displacement node 22 located between the centre of the end wall 12 and the side wall 14. The amplitudes of the displacement oscillations at other points on the end wall 12 have amplitudes greater than zero as represented by the vertical arrows. A central displacement anti-node 21 exists near the centre of the actuator 40 and peripheral displacement anti-node 21' exists near the perimeter of the actuator 40.

FIG. 1A(2) shows one possible pressure oscillation profile illustrating the pressure oscillation within the cavity 11 resulting from the axial displacement oscillations shown in FIG. 1A(1). The solid curved line and arrows represent the pressure at one point in time, and the dashed curved line represents the pressure one half-cycle later. In this mode and higher-order modes, the amplitude of the pressure oscillations has a central pressure anti-node 23 near the centre of the cavity 11 and a peripheral pressure anti-node 24 near the side wall 14 of the cavity 11. The amplitude of the pressure oscillations is substantially zero at the annular pressure node 25 between the pressure anti-nodes 23 and 24. For a cylindrical cavity the radial dependence of the amplitude of the pressure oscillations in the cavity 11 may be approximated by a Bessel function of the first kind. The pressure oscillations described above result from the radial movement of the fluid in the cavity 11, and so will be referred to as "radial pressure oscillations" of the fluid within the cavity 11 as distinguished from the axial displacement oscillations of the actuator 40.

Referring to FIGS. 3 and 1A(2), the operation of the flap valve 50 as described above within the pump 10 causes fluid to flow in the direction indicated by the dashed arrows in FIG. 2A(1) creating a negative pressure outside the primary aperture 16' of the pump 10. Referring more specifically to FIG. 3, the flap valve 50 is disposed within the primary aperture 16' so that the fluid is drawn into the cavity 11 through the primary aperture 16' and expelled from the cavity 11 through the secondary apertures 15 as indicated by the solid arrows, thereby providing a source of reduced pressure at the primary aperture 16'. The fluid flow through the primary aperture 16' as indicated by the solid arrow pointing upwards corresponds to the fluid flow through the vent holes 54 and 55 of the flap valve 50 as indicated by the dashed arrows in FIG. 2A(1) that also point upwards. As indicated above, the operation of the flap valve 50 is a function of the change in direction of the differential pressure (ΔP) of the fluid across the flap valve 50. The differential pressure (ΔP) is assumed to be substantially uniform across the entire surface of the retention plate 52 because its position corresponds to the centre pressure anti-node 23 as shown in FIG. 1A(2), which is generally aligned with the primary aperture 16' in the base 18 of the pump 10 and, therefore, a good approximation that there is no spatial variation in the pressure across the valve 50. When the differential pressure across the flap valve 50 reverses to become a positive differential pressure (+ΔP) as shown in FIG. 2A(1), the biased flap 51 is motivated away from the sealing plate 53 against the retention plate 52 into the open position. In this position, the movement of the flap 51 unblocks the vent holes 55 of the sealing plate 53 so that fluid is permitted to flow through the vent holes 55 and then the aligned vent holes 54 of the retention plate 52 and vent holes 56 of the flap 51 as indicated by the dashed arrows. This provides a source of reduced pressure outside the primary aperture 16' in the base 18 of the pump 10 as also indicated by the dashed arrows. When the differential pressure changes back to a negative differential pressure (−ΔP) as indicated in FIG. 2A(2), fluid begins flowing in the opposite direction through the flap valve 50 as indicated by the dashed arrows, which forces the flap 51 back toward the closed position shown in FIG. 2A. Thus, as the differential pressure (ΔP) cycles the flap valve 50 between the closed and open positions, the pump 10 provides a reduced pressure every half cycle when the flap valve 50 is in the open position.

With further reference to FIGS. 1A(1) and 1A(2), it can be seen that the radial dependence of the amplitude of the axial displacement oscillations of the actuator 40 (the "mode-shape" of the actuator 40) should approximate a Bessel function of the first kind so as to match more closely the radial dependence of the amplitude of the desired pressure oscillations in the cavity 11 (the "mode-shape" of the pressure oscillation). By not rigidly mounting the actuator 40 at its perimeter and allowing it to vibrate more freely about its centre of mass, the mode-shape of the displacement oscillations substantially matches the mode-shape of the pressure oscillations in the cavity 11, thus achieving mode-shape matching or, more simply, mode-matching. Although the mode-matching may not always be perfect in this respect, the axial displacement oscillations of the actuator 40 and the corresponding pressure oscillations in the cavity 11 have substantially the same relative phase across the full surface of the actuator 40 wherein the radial position of the annular pressure node 25 of the pressure oscillations in the cavity 11 and the radial position of the annular displacement node 22 of the axial displacement oscillations of actuator 40 are substantially coincident.

As the actuator 40 vibrates about its centre of mass, the radial position of the annular displacement node 22 will necessarily lie inside the radius of the actuator 40 when the actuator 40 vibrates in its fundamental mode as illustrated in FIG. 1A(1). Thus, to ensure that the annular displacement node 22 is coincident with the annular pressure node 25, the radius of the actuator ($r_{act}$) should preferably be greater than the radius of the annular pressure node 25 to optimize mode-matching. Assuming again that the pressure oscillation in the cavity 11 approximates a Bessel function of the first kind, the radius of the annular pressure node 25 would be approximately 0.63 of the radius from the centre of the end wall 13 to the side wall 14, i.e., the radius of the cavity 11 (r) as shown in FIG. 1. Therefore, the radius of the actuator 40 ($r_{act}$) should preferably satisfy the following inequality: $r_{act} \geq 0.63r$.

Figure 6:
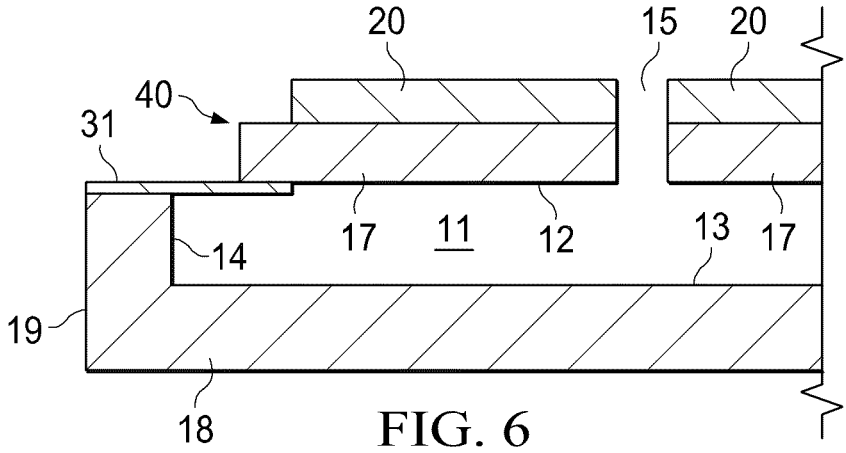
FIG. 6 shows an exploded schematic section of the edge of the pump of FIGS. 1A and 1B illustrating a first embodiment of an isolator.
Figure 6A:
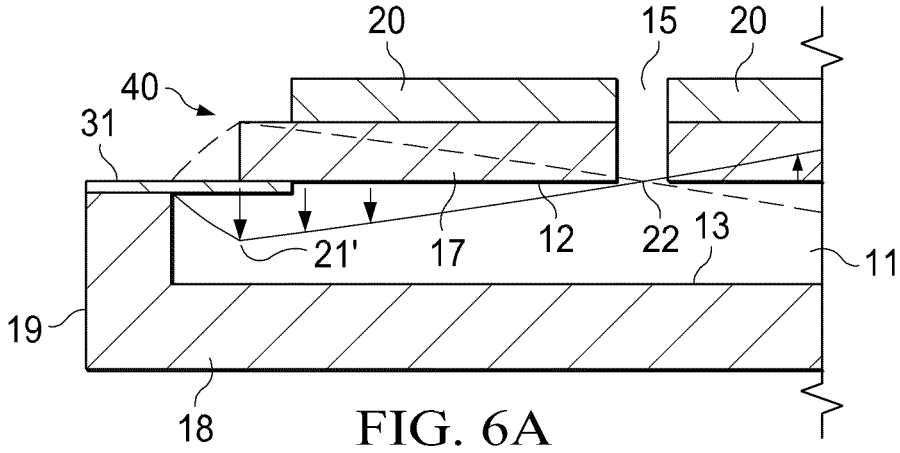
FIG. 6A is a schematic cross-section view showing the displacement oscillations of the driven end wall of the pump in FIG. 6.
Figure 6B:
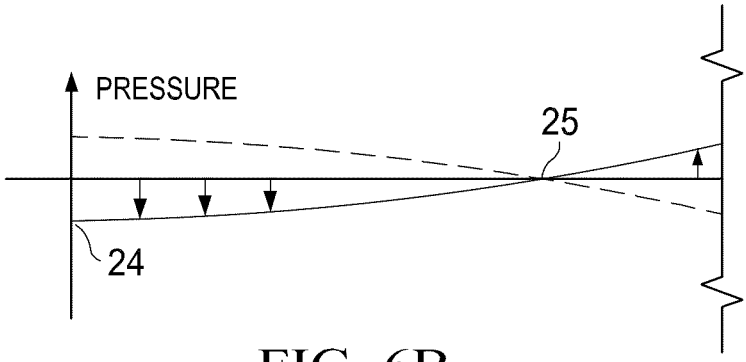
FIG. 6B is a graph of the pressure oscillations within the cavity of the pump in FIG. 6.

Referring now to FIG. 6, which is an exploded cross-section of the edge of the pump 10 of FIG. 1, the isolator 30 is a flexible membrane 31 which enables the edge of the actuator 40 to move more freely as described above by bending and stretching in response to the vibration of the actuator 40 as shown by the displacement of the peripheral displacement oscillations 21' in FIG. 6(*a*). The flexible membrane 31 overcomes the potential dampening effects of the side wall 14 on the actuator 40 by providing a low mechanical impedance support between the actuator 40 and the cylindrical wall 19 of the pump 10 thereby reducing the dampening of the axial oscillations of the peripheral displacement oscillations 21' of the actuator 40. Essentially, flexible membrane 31 minimizes the energy being transferred from the actuator 40 to the side wall 14, which remains substantially stationary. Consequently, the annular displacement node 22 will remain substantially aligned with the annular pressure node 25 so as to maintain the mode-matching condition of the pump 10. Thus, the axial displacement oscillations of the driven end wall 12 continue to efficiently generate oscillations of the pressure within the cavity 11 from the centre pressure anti-node 23 (FIG. 1A) to the peripheral pressure anti-node 24 at the side wall 14.

For a flexible membrane 31 formed from a simple sheet as described above having a uniform thickness ($\delta_m$) and a Young's modulus ($E_m$) that spans an annular gap (g) between the edge of the actuator 40 and the side wall 14 of the cavity 11, the force per unit length required to displace the edge of the flexible membrane 31 ($F_{stretch}$) by an axial displacement (u) may be approximated by the following equation:

$$F_{stretch} = \frac{E_m u^2 \delta_m}{2g^2},$$

where u and $\delta_m$ are much less than g. This may be compared with the approximate force per unit length required to bend the edge of a disc embodiment of the actuator 40 ($F_{bend}$) by the same displacement:

$$F_{bend} = \frac{E_a u \delta_a^3}{2R^3},$$

where the actuator 40 has an effective Young's modulus ($E_a$), thickness ($\delta_a$), and radius (R). For the edge of the actuator 40 to vibrate freely, $F_{stretch}$ should be much smaller than $F_{bend}$ which suggests that the simple flexible membrane 31 should preferably have a thickness ($\delta_m$) characterized by the following inequality:

$$\delta_m << \frac{E_a g^2 \delta_a^3}{E_s u R^3}.$$

In one embodiment wherein the actuator 40 comprises a steel end plate 17 and piezoceramic disc 20 having overall dimensions of g=1 mm, $\delta_a$=1 mm, R=10 mm, and u=10 μm, this inequality requires that the thickness of a flexible membrane 31 composed of Kapton is preferably $\delta_m$<<1,000 microns, and the thickness of a flexible membrane 31 composed of steel is preferably $\delta_m$<<100 microns.

In one non-limiting example, the diameter of the actuator 40 may be 1-2 mm less than the diameter of the cavity 11 such that the flexible membrane 31 spans the peripheral portion of the end wall 12. The peripheral portion may be an annular gap of 0.5-1.0 mm between the edge of the actuator 40 and the side wall 14 of the cavity 11. Generally, the annular width of the flexible membrane 31 should be relatively small compared to the cavity radius (r) such that the actuator diameter is close to the cavity diameter so that the diameter of the annular displacement node 22 is approximately equal to the diameter of the annular pressure node 25, while being large enough to facilitate and not restrict the vibrations of the actuator 40. The flexible membrane 31 may be made from a polymer sheet material of uniform thickness such as, for example, PET or Kapton. In one embodiment, the flexible membrane 31 may be made from Kapton sheeting having a thickness of less than about 200 microns. The flexible membrane 31 may also be made from a thin metal sheet of uniform thickness such as, for example, steel or brass, or any other suitable flexible material. In another embodiment, the flexible membrane 31 may be made from steel sheeting having a thickness of less than about 20 microns. The flexible membrane 31 may be made of any other flexible material suitable to facilitate vibration of the actuator 40 as described above. The flexible membrane 31 may be glued, welded, clamped, soldered, or otherwise attached to the actuator 40 depending on the material used, and either the same process or a different process may be used to attach the flexible membrane 31 to the side wall 14.

While the primary component of motion of the edge of the actuator 40 is substantially perpendicular to the driven end wall 12 or substantially parallel to the longitudinal axis of the cavity 11 (the "axial motion"), the edge of the actuator 40 also has a smaller component of "radial motion" occurring in the plane perpendicular to the longitudinal axis of the cavity 11. For at least this reason, the flexible membrane 31 should also be designed to stretch in a radial direction. Such radial stretching may be achieved by forming the actuator 40 from a thin elastic material as described above or by incorporating structural features into the flexible membrane 31 to enhance the radial flexibility of the flexible member 31 to stretch and compress, i.e., the stretch-ability of the flexible membrane 31, with the radial movement of the actuator 40 to further facilitate the vibration of the actuator 40.

Figure 7A:
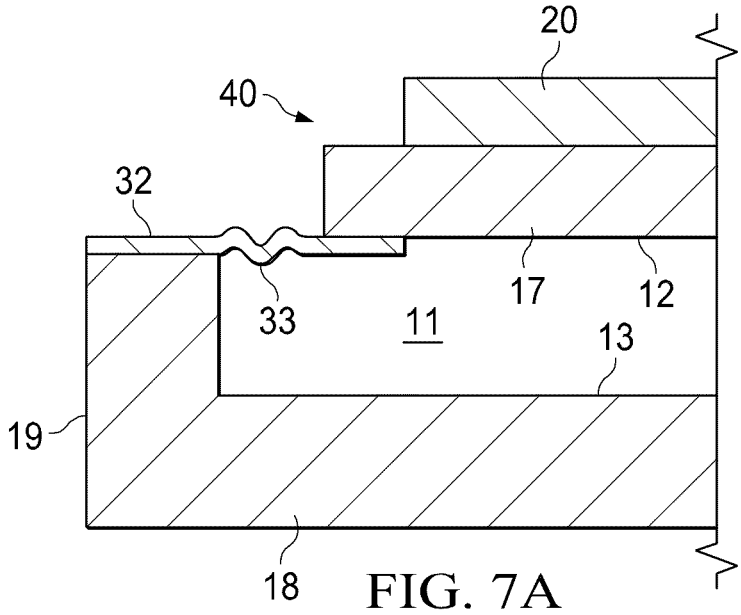
FIGS. 7A and 7B show schematic cross-section views of the pump of FIG. 3 illustrating different embodiments of the isolator of FIG. 3.
Figure 7B:
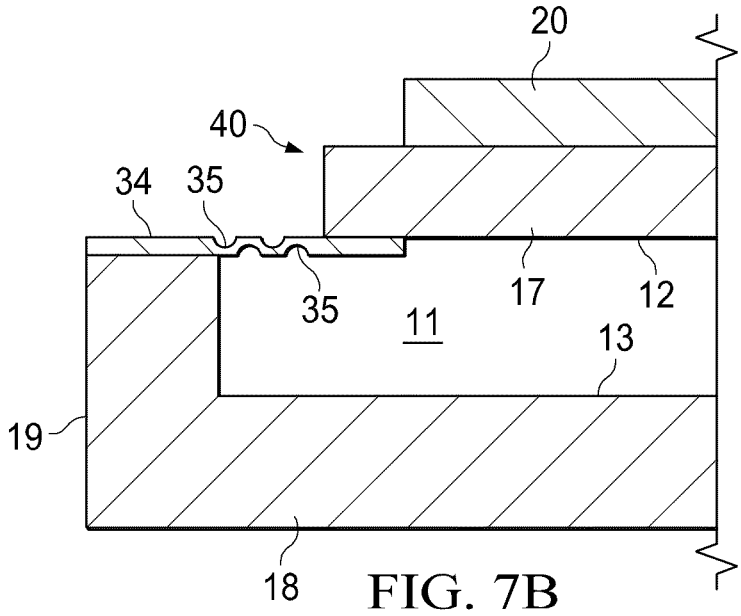

Referring more specifically to FIGS. 7A and 7B, additional embodiments of the flexible membrane 31 having structural features that enhance the stretch-ability of the flexible member 31 to facilitate the radial motion of the actuator 40 are shown. Referring more specifically to FIG. 7A, a first embodiment of a structurally modified flexible membrane 32 is shown that includes an annular concertina portion 33 extending between the actuator 40 and the side wall 14. The concertina portion 33 comprises annular bends in the flexible membrane 32 appearing as waves in FIG. 7A that expand and contract with the motion of the actuator 40 like an accordion. The concertina portion 33 of the flexible membrane 32 effectively reduces the radial stiffness of the flexible membrane 32 thereby enhancing the stretch-ability of the flexible membrane 32 and enabling the actuator 40 to expand and contract more easily in a radial direction.

Referring more specifically to FIG. 7B, a second embodiment of a structurally modified flexible membrane 34 is shown that includes annular, semi-circular grooves 35 staggered on each side of the flexible membrane 34 between the actuator 40 and the side wall 14. The annular grooves 35 of the flexible membrane 34 may be formed by chemical etching, grinding, or any similar processes, or may be formed by laminations. The annular grooves 35 of the flexible membrane 34 effectively reduce the radial stiffness of the flexible membrane 34 thereby enhancing the stretch-ability of the flexible membrane 34 to facilitate the expansion and contraction of the actuator 40 in the radial direction. Note that the structures shown in FIGS. 7A and 7B and similar structures may also beneficially reduce the force required to bend the isolators 32, 34 in the axial direction.

Figure 8:
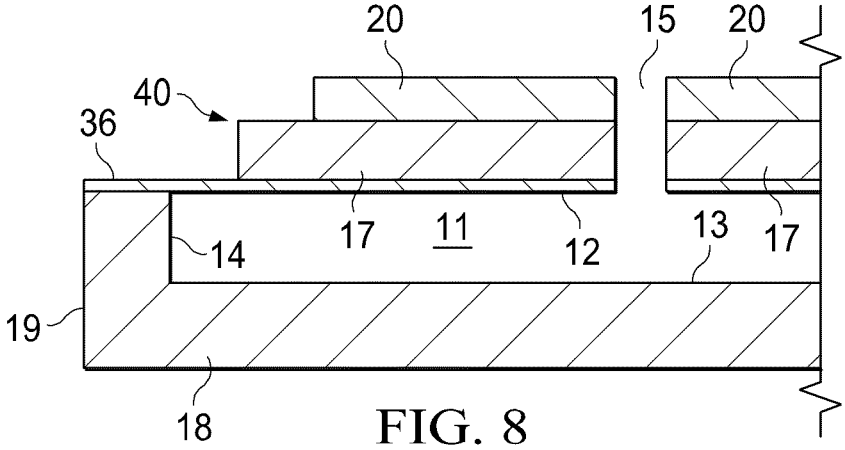
FIG. 8 shows a schematic cross-section view of the pump of FIG. 1 illustrating another embodiment of an isolator.
Figure 9:
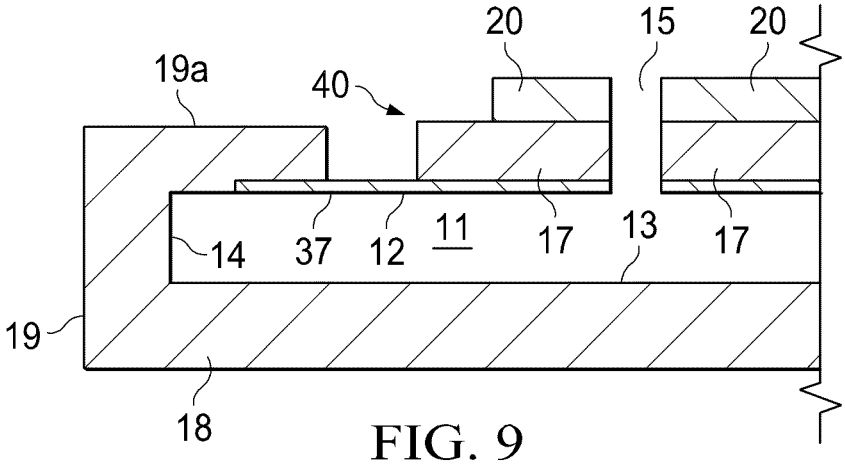
FIG. 9 shows a schematic cross-section view of the pump of FIG. 1 illustrating yet another embodiment of an isolator.

Although the isolator 30 and flexible membranes 31, 32 and 34 shown in the previous figures are ring-shaped components extending between the side wall 14 and the actuator 40, the isolator 30 may also have different shapes and be supported by the cylindrical wall 19 in different ways without extending fully to the side wall 14 of the cavity 11. Referring to FIGS. 8 and 9, alternative embodiments of the flexible membrane 31 are shown including flexible membranes 36 and 37, respectively, that function in a fashion similar to the other flexible membranes 31, 32 and 34. Referring more specifically to FIG. 8, the flexible membrane 36 is formed in the shape of a disc, the inside surface of which forms the end wall 12, rather than the end plate 17. The end plate 17 which remains operatively connected to the upper surface of the flexible membrane 36 as shown. In the embodiments of FIGS. 8 and 9, the end wall 12 still comprises the central portion operatively connected to the actuator 40, and the peripheral portion functioning as the isolator 30 between the side wall 14 and the actuator 40. As such, the flexible member 36 operates in a fashion similar to that of the other flexible membranes 31, 32 and 34.

Referring more specifically to FIG. 9, the cylindrical wall 19 of the pump body includes a lip portion 19*a* extending radially inward from the side wall 14 of the pump body. The inside surface of the lip portion 19*a* facing the cavity 11 forms an outer portion of the peripheral portion of the end wall 12 that is disposed adjacent the side wall 14. The flexible membrane 37 may be ring-shaped or disc-shaped as shown and attached to the inside surface of the lip 19*a* of the cylindrical wall 19 to form the remaining portion of the end wall 12 as described above. Regardless of the shape of the flexible membrane 37, the end wall 12 still comprises the central portion operatively connected to the actuator 40, and a peripheral portion functioning as the isolator 30 between the actuator 40 and the lip 19*a* of the cylindrical wall 19. As such, the flexible member 37 operates in a fashion similar to that of the other flexible membranes 31, 32 and 34. It should be apparent that the structure, suspension and shape of the isolator 30 is not limited to these embodiments, but is susceptible to various changes and modifications without departing from the spirit of the inventions described herein.

In the previous embodiments of the pump 10 shown in FIGS. 1-9, the side wall 14 extends continuously between the end walls 12,13 of the cavity 11, and the radius of the actuator 40 ($r_{act}$) is less than the radius of the cavity 11 (r). In such embodiments, the side wall 14 defines an uninterrupted surface from which the radial acoustic standing wave formed in the cavity 11 is reflected during operation. However, it may be desirable for the radius of the actuator ($r_{act}$) to extend all the way to the side wall 14 making it about equal to the radius of the cavity (r) to ensure that the annular displacement node 22 of the displacement oscillations is more closely aligned with the annular pressure node 25 of the pressure oscillations so as to maintain more closely the mode-matching condition described above.

Figure 10:
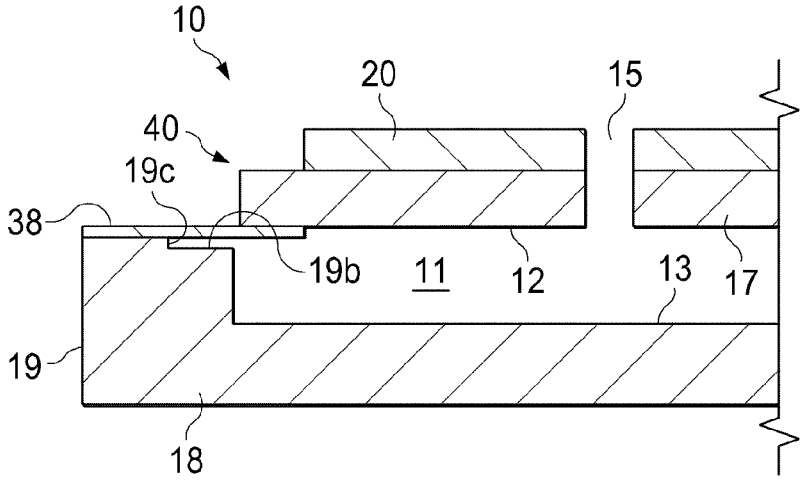
FIG. 10 shows a schematic cross-section view of the pump of FIG. 1 illustrating yet another embodiment of an isolator.

Referring more specifically to FIG. 10, yet another embodiment of the pump 10 is shown wherein the actuator 40 has the same radius as the diameter of the cavity 11 and is supported by a flexible membrane 38 having the same characteristics as the flexible membrane 31 shown in FIG. 5. Because the flexible membrane 38 must enable the edge of the actuator 40 to move freely as it bends in response to the vibration of the actuator 40, the cylindrical wall 19 of the pump body comprises an annular step 19*b* in the upper, inside surface of the cylindrical wall 19 extending radially outward from the side wall 14 to an annular edge 19*c*. The annular step 19*b* is cut sufficiently deep into the upper surface of the cylindrical wall 19 so as not to interfere with the bending of the flexible membrane 38 to enable the actuator 40 to vibrate freely. The step 19*b* should be sufficiently deep to accommodate the bending of the flexible membrane 38, but not so deep as to significantly diminish the resonant quality of the cavity 11 referred to above.

Figure 10A:
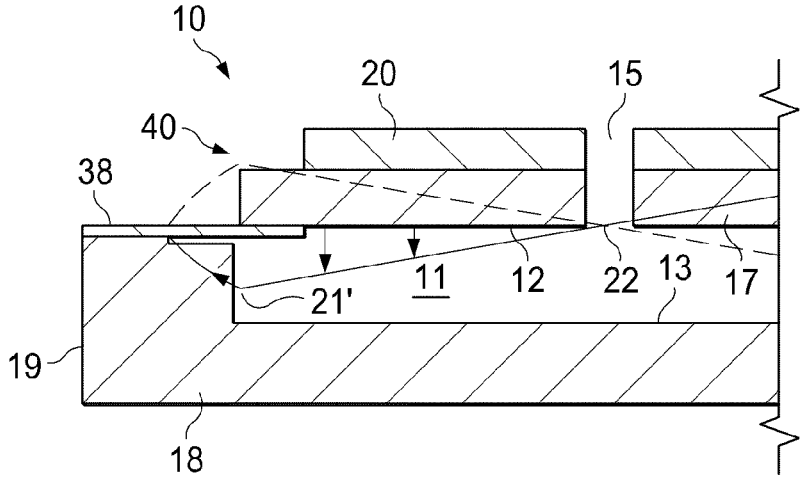
FIG. 10A is a schematic cross-section view showing the displacement oscillations of the driven end wall of the pump in FIG. 10.
Figure 10B:
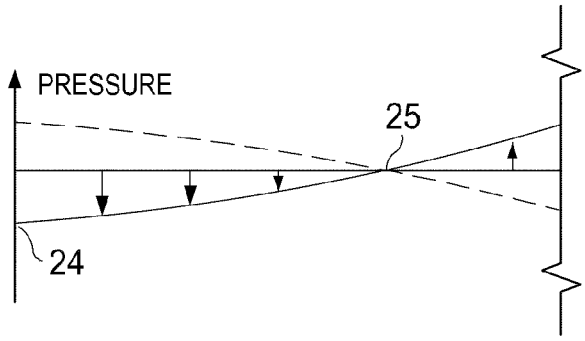
FIG. 10B is a graph of the pressure oscillations within the cavity of the pump in FIG. 10.

As can be seen in FIGS. 10 and 10(A), the driven end wall 12 comprises the lower surface of the end plate 17 and the flexible membrane 38, and has a radius ($r_{end}$) that is greater than the radius of the cavity 11, i.e., $r_{end}$>r. Thus, the peripheral portion of the end wall 12 extends beyond the side wall 14 of the cavity 11. Referring more specifically to FIGS. 10(A) and 10(B), the axial oscillation of the actuator 40 and the corresponding pressure oscillation in the cavity 11 continue to have substantially the same relative phase across the full surface of the actuator 40 with the amplitudes of the displacement oscillations and the pressure oscillations being more closely proportional at the side wall 14. As a result, the radial position of the annular pressure node 25 of the pressure oscillation in the cavity 11 and the radial position of the annular displacement node 22 of the axial oscillation of the actuator 40 may be more coincident to further enhance mode-matching.

To ensure that the side wall 14 still defines a substantially uninterrupted surface from which the radial acoustic standing wave is reflected within the cavity 11, the depth of the step 19*b* is preferably minimized as described above. In one non-limiting example, the depth of the step 19*b* may be sized to maintain so far as possible the resonant qualities of the pump cavity 11. For example, the depth of the step 19*b* may be less than or equal to 10% of the height of the cavity 11.

It should be apparent from the foregoing that an invention having significant advantages has been provided. While the invention is shown in only a few of its forms, it is not just limited but is susceptible to various changes and modifications without departing from the spirit thereof.

I claim:

1. A pump comprising:

a pump body having a substantially cylindrical shape defining a cavity for containing a fluid, the cavity being formed by a side wall closed at one end by an end wall and partially closed at the other end by a driven end wall having a central portion and a peripheral portion extending radially outwardly from the central portion of the driven end wall;

an actuator operatively associated with the central portion of the driven end wall to cause an oscillatory motion of the driven end wall, thereby generating displacement oscillations of the driven end wall in a direction substantially perpendicular thereto with an annular node between the centre of the driven end wall and the side wall when in use;

an isolator being generally ring-shaped having an outside circumference fixed to the side wall and an inside circumference flexibly connected to the peripheral portion of the driven end wall to reduce dampening of the displacement oscillations, the isolator and driven end wall closing the other end of the side wall;

a first aperture disposed at any location in the cavity other than at the location of the annular node and extending through the pump body;

a second aperture disposed at any location in the pump body other than the location of said first aperture and extending through the pump body; and, a valve disposed in at least one of said first aperture and second aperture;

whereby the displacement oscillations generate corresponding radial pressure oscillations of the fluid within the cavity of said pump body causing fluid flow through said first and second apertures when in use.

2. The pump of claim 1 wherein the ratio of the radius of the cavity (r) extending from the longitudinal axis of the cavity to the side wall to the height of the side wall of the cavity (h) is greater than about 1.2.

3. The pump of claim 2 wherein the height (h) of the cavity and the radius (r) of the cavity are further related by the following equation: $h^2/r>4\times10^{-10}$ meters.

4. The pump of claim 2 wherein said second aperture is disposed in one of the end walls at a distance of about 0.63 (r)±0.2(r) from the centre of the end wall.

5. The pump of claim 2 wherein said actuator drives the end wall associated therewith to cause the oscillatory motion at a frequency (f).

6. The pump of claim 2 wherein said actuator drives the end wall associated therewith to cause the oscillatory motion at a frequency (f) wherein the radius (r) is related to the frequency (f) by the following equation:

$$\frac{k_0 c_s}{2\pi f} \le r \le \frac{k_0 c_f}{2\pi f}$$

where $c_s \approx 115$ m/s, $c_r \approx 1970$ m/s, and $k_0 = 3.83$.

7. The pump of claim 1 wherein the lowest resonant frequency of the radial pressure oscillations is greater than about 500 Hz.

8. The pump of claim 1 wherein the frequency of the displacement oscillations of the driven end wall is about equal to the lowest resonant frequency of the radial pressure oscillations.

9. The pump of claim 1 wherein the frequency of the displacement oscillations of the driven end wall is within 20% of the lowest resonant frequency of the radial pressure oscillations.

10. The pump of claim 1 wherein the displacement oscillations of the driven end wall are mode-shape matched to the radial pressure oscillations.

11. The pump of claim 1 wherein said valve permits the fluid to flow through the cavity in substantially one direction.

12. The pump of claim 1 wherein said isolator is a flexible membrane.

13. The pump of claim 12 wherein the flexible membrane is formed from plastic.

14. The pump of claim 13 wherein the annular width of flexible membrane is between about 0.5 and 1.0 mm and the thickness of the flexible membrane is less than about 200 microns.

15. The pump of claim 12 wherein the flexible membrane is formed from metal.

16. The pump of claim 15 wherein the annular width of flexible membrane is between about 0.5 and 1.0 mm and the thickness of the flexible membrane is less than about 20 microns.

17. The pump of claim 1 wherein the side wall of the pump comprises a recess extending radially outwards adjacent at least one of the end walls within the cavity.

18. The pump of claim 2 wherein the ratio of r/h is between about 10 and about 50 when the fluid in use within the cavity is a gas.

19. The pump of claim 3 wherein the ratio of $h^2/r$ is between about $10^{-3}$ meters and about $10^{-6}$ meters when the fluid in use within the cavity is a gas.

20. The pump of claim 2 wherein the volume of the cavity is less than about 10 ml.

21. The pump of claim 1 further comprising:

a second actuator operatively associated with the central portion of the other end wall to cause an oscillatory motion of such end wall in a direction substantially perpendicular thereto; and a second isolator operatively associated with the peripheral portion of such end wall to reduce the dampening of the oscillatory motion of such end wall by the side wall within the cavity.

22. The pump of claim 2 wherein the radius of said actuator is greater than or equal to 0.63(r).

23. The pump of claim 22 wherein the radius of said actuator is less than or equal to the radius of the cavity (r).

24. The pump of claim 1 wherein said actuator comprises a piezoelectric component for causing the oscillatory motion.

25. The pump of claim 1 wherein said actuator comprises a magnetostrictive component for providing the oscillatory motion.

26. A pump comprising:

a pump body having a substantially cylindrical shaped cavity having a side wall at least partially closed by two end surfaces for containing a fluid, the cavity having a height (h) and a radius (r), wherein the ratio of the radius (r) to the height (h) is greater than about 1.2;

an actuator operatively associated with a central portion of one end surface and adapted to cause an oscillatory motion of the one end surface with an annular node between the centre of the one end surface and the side wall when in use;

an isolator being generally ring-shaped having an outside circumference fixed to the side wall and an inside circumference flexibly connected to a peripheral portion of the other end surface to reduce dampening of the oscillatory motion, the isolator and driven end wall closing the other end surface;

a first aperture disposed at any location in the cavity other than at the location of the annular node and extending through the pump body;

a second aperture disposed at any location in the pump body other than the location of said first aperture and extending through the pump body; and, a valve disposed in at least one of said first aperture and second aperture to enable the fluid to flow through the cavity when in use.

27. The pump of claim 26 wherein the oscillatory motion generates radial pressure oscillations of the fluid within the cavity causing fluid flow through said first aperture and second aperture.

28. The pump of claim 27 wherein the lowest resonant frequency of the radial pressure oscillations is greater than about 500 Hz.

29. The pump of claim 27 wherein the frequency of the oscillatory motion is about equal to the lowest resonant frequency of the radial pressure oscillations.

30. The pump of claim 27 wherein the frequency of the oscillatory motion is within 20% of the lowest resonant frequency of the radial pressure oscillations.

31. The pump of claim 27 wherein the oscillatory motion is mode-shape matched to the radial pressure oscillations.

32. The pump of claim 26 wherein the side wall of the pump comprises a recess extending radially outwards adjacent at least one of the end walls within the cavity.

33. The pump of claim 26 wherein the height (h) of the cavity and the radius (r) of the cavity are further related by the following equation: $h^2/r>4\times10^{-10}$ meters.

34. The pump of claim 26 wherein said actuator drives the end surface of the cavity associated therewith to cause the oscillatory motion at a frequency (f) wherein the radius (r) is related to the frequency (f) by the following equation:

$$\frac{k_0 c_s}{2\pi f} \le r \le \frac{k_0 c_f}{2\pi f}$$

where $c_s \approx 115$ m/s, $c_r \approx 1970$ m/s, and $k_0 = 3.83$.

35. The pump of claim 26 wherein said isolator is a flexible membrane.

36. The pump of claim 35 wherein the flexible membrane is formed from plastic.

37. The pump of claim 36 wherein the annular width of flexible membrane is between about 0.5 and 1.0 mm and the thickness of the flexible membrane is less than about 200 microns.

38. The pump of claim 35 wherein the flexible membrane is formed from metal.

39. The pump of claim 38 wherein the annular width of flexible membrane is between about 0.5 and 1.0 mm and the thickness of the flexible membrane is less than about 20 microns.

40. The pump of claim 26 wherein the radius of said actuator is greater than or equal to 0.63(r).

41. The pump of claim 40 wherein the radius of said actuator is less than or equal to the radius of the cavity (r).

42. The pump of claim 26 wherein said second aperture is disposed in one of the end surfaces at a distance of about 0.63(r)±0.2(r) from the centre of the end surface.

43. The pump of claim 26 wherein said valve permits the fluid to flow through the cavity in substantially one direction.

44. The pump of claim 26 wherein the ratio of r/h is within the range between about 10 and about 50 when the fluid in use within the cavity is a gas.

45. The pump of claim 26 wherein the ratio of $h^2/r$ is between about $10^{-3}$ meters and about $10^{-6}$ meters when the fluid in use within the cavity is a gas.

46. The pump of claim 26 wherein the volume of the cavity is less than about 10 ml.

47. The pump of claim 26 further comprising:

a second actuator operatively associated with a central portion of the other end surface of the cavity to cause an oscillatory motion of such end surface; and a second isolator operatively associated with a peripheral portion of such end surface to reduce the dampening of the oscillatory motion.

48. The pump of claim 26 wherein said actuator comprises a piezoelectric component for causing the oscillatory motion.

49. The pump of claim 26 wherein said actuator comprises a magnetostrictive component for providing the oscillatory motion.

50. The pump of claim 26 wherein one of the end surfaces of the cavity has a frusto-conical shape wherein the height (h) of the cavity varies from a first height at about the centre of the one end surface to a second height adjacent the side wall smaller than the first height.

51. The pump of claim 26 wherein one of the end surfaces of the cavity has a frusto-conical shape wherein the height (h) of the cavity increases from a first height at about the centre of the one end surface to a second height adjacent the side wall.

52. The pump of claim 51 wherein the ratio of the first height to the second height is no less than about 50%.

53. The pump of claim 1 wherein the valve is a flap valve.

54. The pump of claim 26 wherein the valve is a flap valve.

* * * * *